US007073674B2

(12) United States Patent
Knuth et al.

(10) Patent No.: US 7,073,674 B2
(45) Date of Patent: Jul. 11, 2006

(54) RESEALABLE NURSER LINER

(75) Inventors: Rosemary F. Knuth, Congers, NY (US); John Rousso, Trumbull, CT (US); Henry Kalinoski, Doylestown, PA (US); Paul Siracusa, Florida, NY (US)

(73) Assignee: Playtex Products, Inc., Westport, CT (US)

( * ) Notice: Subject to any disclaimer, the term of this patent is extended or adjusted under 35 U.S.C. 154(b) by 199 days.

(21) Appl. No.: 10/659,759

(22) Filed: Sep. 10, 2003

(65) Prior Publication Data

US 2005/0053698 A1 Mar. 10, 2005

(51) Int. Cl.
*A61J 9/00* (2006.01)
*A61J 9/06* (2006.01)

(52) U.S. Cl. ..... 215/11.3; 215/11.6; 383/113; 426/117

(58) Field of Classification Search ..... 215/11.1, 215/11.3; 383/113; 426/117; 220/62.12, 220/495.03
See application file for complete search history.

(56) References Cited

U.S. PATENT DOCUMENTS

| | | | | |
|---|---|---|---|---|
| 2,541,934 A | | 2/1951 | Piazze | 215/11 |
| 2,697,531 A | | 12/1954 | Hood | 215/11.1 |
| 3,334,764 A | | 8/1967 | Fouser | 215/11 |
| 3,394,018 A | | 7/1968 | Velonis et al. | |
| 3,822,806 A | | 7/1974 | Grimes | 215/11.3 |
| 3,871,542 A | | 3/1975 | Hammer | 215/11.3 |
| 3,931,886 A | | 1/1976 | Yamauchi | 215/11.3 |
| 4,051,265 A | * | 9/1977 | Kirshenbaum et al. | 426/107 |
| 4,139,517 A | * | 2/1979 | Zaganiacz | 524/611 |
| 4,392,576 A | * | 7/1983 | Berger et al. | 215/12.2 |
| 4,600,104 A | | 7/1986 | Yanase | 383/113 |
| 4,623,069 A | | 11/1986 | White | |
| 4,629,080 A | | 12/1986 | Carveth | |
| 4,634,006 A | | 1/1987 | Yanase | |
| 4,637,934 A | | 1/1987 | White | |
| 4,640,424 A | | 2/1987 | White | |
| 4,640,425 A | | 2/1987 | Cabernoch | 215/11 |
| 4,657,151 A | | 4/1987 | Cabernoch | 215/11 |
| 4,706,827 A | | 11/1987 | Cabernoch et al. | 215/11.3 |
| 4,711,359 A | | 12/1987 | White et al. | 215/11.1 |
| 4,801,007 A | | 1/1989 | Rule | 215/11.3 |
| 4,869,912 A | | 9/1989 | McCoy et al. | 215/11.3 |
| 4,872,553 A | * | 10/1989 | Suzuki et al. | 206/524.4 |
| 4,919,983 A | | 4/1990 | Fremin | 215/11.3 |
| 4,928,474 A | * | 5/1990 | Schirmer | 53/425 |
| 4,930,690 A | | 6/1990 | Angeloz et al. | 215/11.1 |
| 4,950,236 A | | 8/1990 | Wilson | 215/11.5 |
| 4,982,880 A | | 1/1991 | Angeloz et al. | 215/11.1 |
| 4,983,432 A | * | 1/1991 | Bissot | 428/35.7 |
| 5,061,534 A | | 10/1991 | Blemberg et al. | 428/36.7 |
| 5,295,957 A | * | 3/1994 | Aida et al. | 604/74 |
| 5,358,476 A | | 10/1994 | Wilson | 604/74 |
| 5,385,251 A | | 1/1995 | Dunn | 215/11.3 |
| 5,424,086 A | | 6/1995 | Walker | 426/117 |
| 5,617,972 A | * | 4/1997 | Morano et al. | 221/33 |

(Continued)

FOREIGN PATENT DOCUMENTS

| | | |
|---|---|---|
| EP | 0328055 | 2/1988 |

(Continued)

*Primary Examiner*—Sue A. Weaver
(74) *Attorney, Agent, or Firm*—Ohlandt, Greeley, Ruggiero & Perle, L.L.P.

(57) ABSTRACT

There is provided a nurser liner having a closure member for selectively sealing the liner. The nurser liner limits the transmission of oxygen and/or UV rays into the inner volume of the liner.

24 Claims, 2 Drawing Sheets

U.S. PATENT DOCUMENTS

| | | | | | |
|---|---|---|---|---|---|
| 5,622,431 | A | * | 4/1997 | Simonsen | 383/63 |
| 5,750,226 | A | * | 5/1998 | Macauley et al. | 428/36.4 |
| 5,830,545 | A | | 11/1998 | Frisk | 428/34.7 |
| 5,895,694 | A | | 4/1999 | Zavadsky et al. | 428/36.7 |
| 5,896,989 | A | * | 4/1999 | Ropiak et al. | 206/438 |
| 6,050,432 | A | | 4/2000 | Koehnke | 215/11.3 |
| 6,117,506 | A | * | 9/2000 | Graboski et al. | 428/35.9 |
| 6,346,285 | B1 | | 2/2002 | Ramesh | 426/105 |
| 6,479,160 | B1 | | 11/2002 | Tsai et al. | 428/474.4 |
| 6,500,559 | B1 | | 12/2002 | Hofmeister et al. | 428/474.4 |
| 6,576,278 | B1 | | 6/2003 | Sprehe | 426/117 |
| 2003/0047467 | A1 | | 3/2003 | Smith et al. | 206/221 |
| 2003/0129434 | A1 | | 7/2003 | Glawe et al. | 428/515 |

FOREIGN PATENT DOCUMENTS

| | | | | |
|---|---|---|---|---|
| EP | 0345930 A1 | * | 12/1989 | |
| JP | 5004645 A | * | 1/1993 | 383/113 |
| WO | WO 8800038 | | 1/1988 | |
| WO | WO 9014066 | * | 11/1990 | |

* cited by examiner

RESEALABLE NURSER LINER

BACKGROUND OF THE INVENTION

1. Field of the Invention

The present invention relates generally to liners for nurser bottles. More particularly, the present invention relates to liners that are resealable.

2. Description of the Prior Art

Breast milk is a valuable source of nutrition for infants. It contains carbohydrates, proteins, fats, enzymes, minerals, vitamins, and hormones that infants require. It also contains valuable antibodies that can help infants resist infections. Many nutrients found in milk can deteriorate depending on storage conditions and length of storage time. For example, nutrients, such as fats/lipids and vitamins, can degrade when exposed to oxygen and/or light. Milk can turn rancid when lipids degrade as a result of oxidative deterioration, or lipid peroxidation. This produces a foul, offensive odor. Some vitamins degrade when exposed to light and/or oxygen. This deterioration of nutrients leads to decreased nutritional value, decreased freshness, and decreases the benefits of feeding the infant breast milk.

Disposable liners for containing breast milk are used with rigid holders to provide a clean, sanitary container for each use, instead of reusable bottles, which require regular washing. Resealable closure members have been incorporated laterally or horizontally across such liners. In U.S. Pat. No. 6,576,278 to Sprehe, a nurser liner is shown having a continuous, elongated, profiled reclosable fastener disposed laterally across the periphery of the top portion of the enclosure area. In U.S. Pat. No. 5,385,251 to Dunn, a nurser liner is shown having a sealing member made up of cooperating projection members that are disposed laterally across the periphery of the top portion of the enclosure area.

Such liners suffer from the drawback of allowing degradation of the breast milk due to oxygen or UV rays. The oxygen or UV transmission can occur because the contemporary bags do not provide proper air-tight sealing mechanisms, and also fail to adequately prevent oxygen and UV transmission through the bag itself. Accordingly, there is a need for a breast milk storage bag, which reduces or eliminates degradation of the breast milk due to oxygen or UV rays.

SUMMARY OF THE INVENTION

Against the foregoing background, it is an object of the present invention to provide a liner having properties that reduce or eliminate degradation of the breast milk over time due to oxygen.

It is another object of the present invention to provide such a liner having properties that reduce or eliminate degradation of the breast milk over time due to light and/or UV rays.

It is yet another object of the present invention to provide such a liner that has improved tactile properties.

It is a further object of the present invention to provide such a liner that is easily manufactured. It is yet a further object of the present invention to provide such a liner with a multi-layer construction so that different materials having different desired properties can be utilized to provide a liner with all of the desired properties.

These and other objects and advantages of the present invention are provided by a breast milk storage bag that protects the nutrients of breast milk. The bag limits the transmission of oxygen through the bag and absorbs UV rays or impedes them from transmitting through the bag to the breast milk. By limiting the transmission of oxygen and light, degradation of nutrients, such as lipids and vitamins, is greatly inhibited. The bag utilizes materials with low oxygen transmission rates, thus giving extremely good barrier properties to oxygen. Also, an airtight sealing mechanism can be incorporated into the bag so that the material along with the closure results in a bag with an overall very low oxygen transmission rate. In order to incorporate properties to resist UV transmission, UV absorbers and/or inhibitors can also be added to the materials that comprise the bag. This limits damage to vitamins due to light or UV rays.

In one aspect of the present invention, a nurser liner is provided that has a body defining an inner volume, and the liner has an oxygen transmission rate into the inner volume of less than about 2.0 cubic centimeters over a 24-hour period.

In another aspect of the present invention, a nurser liner is provided that has a body defining an inner volume, and the body is at least partially made with an anti-UV component that reduces transmission of UV rays into the inner volume.

In another aspect of the present invention, a nurser liner is provided that has a body defining an inner volume, and the body is at least partially made of a material selected from nylon, ethylene vinyl alcohol, polyester, or any combinations thereof.

In another aspect of the present invention, an infant feeding assembly is provided having a liner and a holder. The liner has a body defining a first volume. The holder has an open end and defines a second volume. The liner is disposed in the second volume. The liner has an oxygen transmission rate into the first volume of less than about 2.0 cubic centimeters over a 24-hour period.

In another aspect of the present invention, an infant feeding assembly is provided having a liner and a holder. The liner has a body defining a first volume. The holder has an open end and defines a second volume. The liner is disposed in the second volume. The body is at least partially made with an anti-UV component that reduces transmission of UV rays into the first volume.

In another aspect of the present invention, an infant feeding assembly is provided having a liner and a holder. The liner has a body defining a first volume. The holder has an open end and defines a second volume. The liner is disposed in the second volume. The body is at least partially made from a material selected from nylon, ethylene vinyl alcohol, polyester, and any combinations thereof.

In another aspect of the present invention, a method of storing breast milk is provided in which UV ray transmission into an inner volume of a nurser liner used for storing the breast milk is impeded.

As stated above, for another embodiment, the liner body can be at least partially made from a material that impedes transmission of UV rays. The liner body can be at least partially made from: nylon, ethylene vinyl alcohol, polyester, and any combinations thereof.

The liner preferably has a closure member that is selectively resealable and provides selective access to the inner volume. The liner body can have a plurality of layers secured to each other, with at least one of the layers having a different material from another of the layers. The at least one of the plurality of layers can be at least partially made from ethylene vinyl acetate. The at least one of the plurality of layers can be at least partially made from low-density polyethylene. Other materials and combinations of materials can also be used, such as, for example, combining ethylene vinyl acetate and low-density polyethylene in one or more layers.

The anti-UV component can be added to the body at about 0.1 percentage by weight (wt %) to 10 wt %. The anti-UV component can also be added to the body at about 1.5 wt % to 4 wt %. The liner body can have first and second panels with the same size and shape, and each of the first and second panels can have the plurality of layers.

The plurality of layers can be laminated together. The plurality of layers can be at least an outer layer made of a first material, an intermediate layer made of a second material, and an inner layer made of a third material. At least one of the first material, the second material or the third material can be ethylene vinyl acetate. At least one of the first material, the second material or the third material can be low-density polyethylene. Additionally, other materials and combinations of materials can also be used for each, some or all of the plurality of layers, such as, for example, combining ethylene vinyl acetate and low-density polyethylene in one or more of the plurality of layers.

BRIEF DESCRIPTION OF THE DRAWINGS

The foregoing, and still further objects and advantages of the present invention, will be more apparent from the following detailed explanation of the preferred embodiments of the invention in connection with the accompanying drawings.

DETAILED DESCRIPTION OF THE INVENTION

Figure 1:
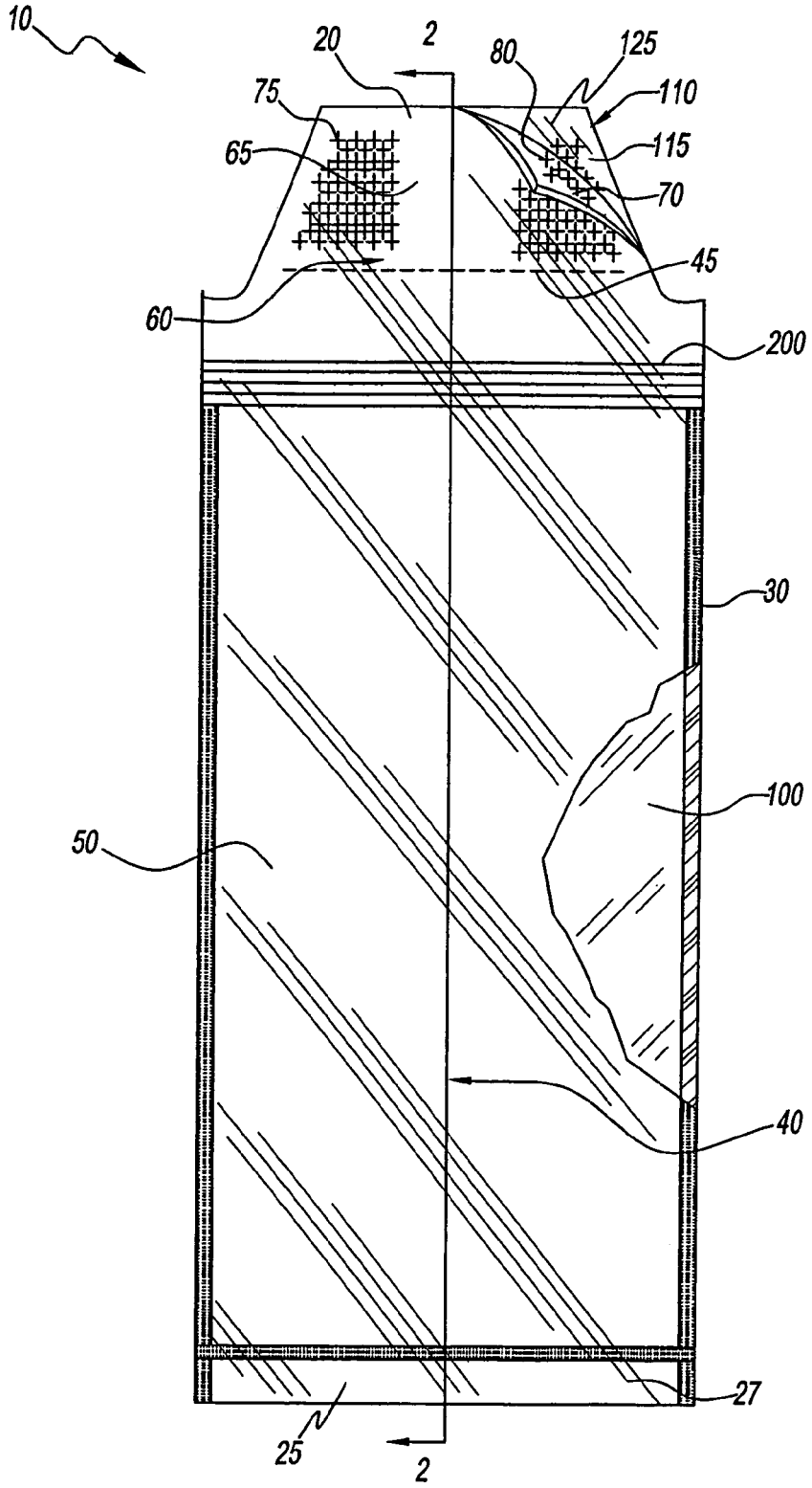
FIG. 1 is a plan view of a liner of the present invention.

Referring to the drawings and, in particular, to FIG. 1, there is provided a liner of the preferred embodiment, which is generally represented by reference numeral 10. The liner 10, preferably, has a collapsed or flattened rectangular shape and can be manipulated into a tubular or cylindrical shape by expanding the inner volume of the liner. However, alternative shapes can also be used, such as, for example, tubular. In an alternative tubular liner 10, there is no seam along the outer sidewall of the liner.

The liner 10 has an upper end 20 and a lower end 25. The liner 10 is preferably formed by a first panel 50 and a second panel 100. First and second panels 50, 100 are connected along a periphery 30 of the liner 10, except at upper end 20, to form a sealable enclosure 40. However, enclosure 40 can be alternatively formed, such as, for example, a tubular sidewall. Preferably, first and second panels 50, 100 are heat-sealed together along the periphery 30 of the panels. However, alternative securing methods and structures can be used to form enclosure 40, such as, for example, adhesive. Lower end 25 of the liner 10 preferably has a gusset 27 or other type of fold, which provides added strength and facilitates opening of the liner from its collapsed state. Additionally, gusset 27 allows the bag to stand on its own when in an opened state for convenience to the user.

Preferably, first and second panels 50, 100 along upper end 20 have first and second tabs 60, 110, respectively. First and second tabs 60, 110 preferably have a trapezoidal shape such that the left side of the tab is substantially symmetrical to the right side of the tab. First and second tabs 60, 110 preferably each have first, textured surfaces 65, 115 and second, non-textured surfaces 70, 120 (not shown), which are opposite the first surfaces.

In the preferred embodiment, a tab perforation 45 is provided at the base of each tab 60, 110 to facilitate removal of the tabs after the liner 10 has been assembled in a rigid holder (not shown). An example of a holder usable with liner 10 is disclosed in U.S. application Ser. No. 10/426,902, filed Apr. 30, 2003, which is commonly owned with this pending application. Applicants hereby incorporate by reference the disclosure of that application in its entirety. However, the present invention is usable with other types of holders of varying sizes, shapes and securing structures. Additionally, liner 10 is usable without a holder.

In a preferred embodiment, the first surfaces 65, 115 of tabs 60, 110 are preferably at least partially textured and have a tactile feel, whereas the second surfaces 70, 120 have a non-tactile feel. The textured surface 115 is positioned adjacent a non-textured surface 70 when the liner 10 is in its collapsed or flattened form.

First and second tabs 60, 110 have a plurality of protuberances 75, 125 on their first, textured surfaces 65, 115 and a plurality of penetrated depressions 80 on their second, non-textured surfaces 70, 120, respectively. Preferably, the protuberances 125 of second tab 110 correspondingly mate with the depressions 80 on the first tab 60 when the liner 10 is in its collapsed or flattened form. The texture of the first surfaces 65, 115 remains, even when the first and second tabs 60, 110 are separated from each other.

Liner 10 preferably has a resealable, closure member 200. Closure member 200 allows selective access to the interior volume of enclosure 40 and provides a substantially air-tight seal for the enclosure for the storage of liquids, such as, breast milk. Throughout this specification, reference is made to the storage of "breast milk." However, the present invention contemplates the storage of other liquids, including formula or milk, which contain nutrients that are subject to degradation and require barrier protection from such. Also, the present invention contemplates the use of the features of liner 10 described herein with a non-resealable closure member or no closure member, such as, for example, liner 10 being pre-filled with formula and pre-sealed. An example of an alternative closure member 200 usable with liner 10 is disclosed in U.S. application Ser. No. 10/643,595, filed Aug. 19, 2003, which is commonly owned with this pending application. Applicants hereby incorporate by reference the disclosure of that application in its entirety.

In this embodiment, closure member 200 is preferably a plurality or series of corresponding projection members disposed adjacent to each other, which engage with each other when pressed together. The projection members can have shapes that facilitate the engagement and disengagement of the closure member 200, and maintain the air-tight seal. While the preferred embodiment uses sealing projection members of closure or sealing member 200, the present invention contemplates the use of alternative resealable closure structures, shapes, and/or methods that provide for an air-tight seal, such as, for example, a zipper-type closure. Also, closure member 200 can be heat-sealed into position along first and second panels 50, 100. This heat-sealing can be done at the same time that the first and second panels 50, 100 are heat-sealed along periphery 30.

Figure 2:
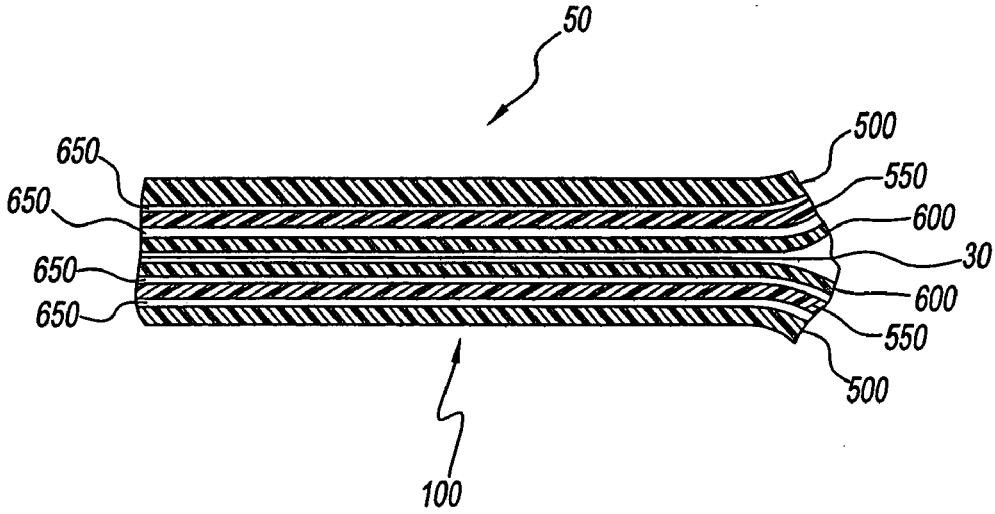
FIG. 2 is a side cross-sectional view of a portion of the liner of FIG. 1 taken along line 2—2 of FIG. 1.

Referring to FIGS. 1 and 2, first and second panels 50, 100 are preferably constructed into a multi-layered film to provide for improved barrier protection for the enclosure 40, such as, for example, to limit the transmission of oxygen through the liner 10 or to absorb UV rays or impede them from transmitting through the liner to the breast milk stored in enclosure 40. In the preferred embodiment, first and second panels 50, 100 each have an outer layer 500, an intermediate layer 550, and an inner layer 600. The multi-layered construction allows for the use of different materials having different desired properties, e.g., low oxygen transmission rate or low UV transmission rate, to be combined to provide all of the desired properties to the liner 10. Liner 10 preferably uses materials, which provide for clarity or transparency, as well as strength and flexibility. While the preferred embodiment uses three layers, i.e., outer layer 500, intermediate layer 550 and inner layer 600, the present invention contemplates the use of any number of layers to achieve the desired properties of liner 10.

In the preferred embodiment, outer, intermediate, and inner layers 500, 550 and 600 are secured together through a lamination process, such as, for example, providing an adhesive layer 650 between each of the outer, intermediate and inner layers. Adhesive layers 650 can be made from any suitable bonding material. The adhesive layers 650 can be the same material or different materials. The adhesive layers 650 can be selected as suited for adhering the particular layers, e.g., outer layer 500 to intermediate layer 550, and their corresponding materials, together. Alternative methods can also be used to secure outer, intermediate, and inner layers 500, 550 and 600.

Outer layer 500 will be handled by a user and preferably has good tactile properties to facilitate manipulation of the liner 10. Preferably, outer layer 500 is made from ethylene vinyl acetate (EVA). EVA provides the desired tactile property including flexibility and gripability. However, the present invention contemplates the use of other materials for outer layer 500 that provide these desired tactile properties.

The intermediate layer 550 is not in contact with either the user and/or the atmosphere, nor with the inner volume of liner 10 and the breast milk stored therein. However, intermediate layer 550 should provide for an acceptable bond between the other two layers, e.g., outer layer 500 and inner layer 600, and their corresponding materials. Preferably, the intermediate layer 550 is made from nylon. Nylon provides the desired barrier property of a low oxygen transmission rate. However, the present disclosure contemplates the use of other materials for intermediate layer 550 that provide this desired barrier property of low oxygen transmission rate, such as, for example, polyester or ethylene vinyl alcohol (EVOH). Additionally, the present invention contemplates the positioning of the nylon in other layers of liner 10 to provide the desired barrier property of the low oxygen transmission rate.

The inner layer 600 is in contact with the inner volume of liner 10 and the breast milk stored therein. Preferably, inner layer 600 is made from low-density polyethylene (LDPE). LDPE provides the desired properties of flexibility, sealability, moisture barrier, and strength.

The preferred embodiment uses the multi-layered construction of liner 10 to achieve the desired properties of low oxygen transmission rate, low UV transmission rate, strong moisture barrier, flexibility, and strength. However, the present invention contemplates the use of the multi-layered construction of liner 10 to achieve other desired properties of the liner, such as, for example, low gas permeability, barrier properties to water vapors and aromas, easy thermoforming, and high strength parameters. Also, while the preferred embodiment uses the multi-layered construction to achieve a liner 10 with both a low oxygen transmission rate, and acceptable moisture barrier, flexibility, and strength properties, the present invention contemplates the use of alternative methods and material(s), such as, for example, co-extrusion or coatings on a core or substrate, for providing liner 10 with the attributes described herein.

Liner 10 also provides for UV resistivity. Preferably, liner 10 has one or more anti-UV transmission components and/or additives and/or combinations of anti-UV transmission components, such as, for example, UV absorbers and/or UV inhibitors, incorporated into the liner. The UV absorbers and/or UV inhibitors are components and/or additives that are known in the art or known in the future. In the preferred embodiment, a UV absorber is added to the material during the manufacturing process. However, alternative methods can also be used to resist transmission of the UV rays through liner 10 and penetration into the breast milk stored therein, such as, for example, including an additional layer of material having strong UV resistive properties. Preferably, the UV absorbers are added to the material of liner 10 in the range of about 0.1 wt % to 10 wt %. More preferably, the UV absorbers are added to the material of liner 10 in the range of about 1.5 wt % to 4 wt %.

The following non-limiting example serves to further illustrate the present invention. It will be appreciated by one of ordinary skill in the art that variations in the arrangements and alternatives in the elements of the components of this example are within the scope of the present invention.

Liner 10 was tested against liners made by GERBER®, MEDELA®, LANSINOH®, and AVENT® for oxygen transmission rates (OTR). The GERBER® liner was made from LDPE and EVA, and the MEDELA® liner was made from LDPE and polyethylene terephthalate. The test was performed at ambient conditions of temperature 23° C.+/−2° C. with a humidity of $O_2$ of 39% using a MOCON® 2/20 'T' model instrument and a MOCON® 2/60 model instrument. A first side of each of the liners was placed at a pressure of 760 mm Hg with a content of 21% $O_2$ and a second side of each of the liners was placed at a pressure of 760 mm Hg with a content of 100% $N_2$. Table One indicates the results of the testing for oxygen transmission rates in cubic centimeters for the entire liner over a 24-hour time period:

TABLE 1

| Liner | Oxygen Transmission Rate (OTR) cc/(Package * 24 hours) |
|---|---|
| GERBER ® | 23.9 |
| MEDELA ® | 15.0 |
| LANSINOH ® | 2.2 |
| AVENT ® | 29.6 |
| Liner 10 | 0.284 |

As indicated in Table One, liner 10 had an OTR that was one order of magnitude less than the next closest liner, which was manufactured by MEDELA®, and two orders of magnitude less than the other liners. By significantly reducing the oxygen transmission through liner 10 and into the breast milk stored therein, degradation of nutrients in the breast milk, such as, for example, lipids and vitamins, is greatly inhibited. Liner 10, and its significantly reduced oxygen transmission rate, prevents the breast milk from turning rancid from lipids degrading as a result of oxidative deterioration, or lipid peroxidation.

From the test data, it was determined that the OTR of liner 10 should preferably be less than 2.0 cc over a 24-hour period for substantially eliminating the degradation of nutrients in the breast milk, such as, for example, lipids and vitamins. More preferably, the OTR for liner 10 should be less than 1.0 cc over a 24-hour period for substantially eliminating the degradation of nutrients in the breast milk. Most preferably, the OTR for liner 10 should be less than 0.284 over a 24-hour period for substantially eliminating the degradation of nutrients in the breast milk.

The present invention having been thus described with particular reference to the preferred forms thereof, it will be obvious that various changes and modifications may be made therein without departing from the spirit and scope of the invention as defined in the appended claims.

What is claimed is:

1. A nurser liner comprising:

a body having a plurality of panels that are connected to each other to define an inner volume; and a closure member connected to said plurality of panels and being selectively resealable, said closure member providing access to said inner volume, said plurality of panels comprising an oxygen barrier, wherein said body and said closure member have an oxygen transmission rate into said inner volume of less than 2.0 cubic centimeters over a 24-hour period.

2. The liner of claim 1, wherein said oxygen transmission rate into said inner volume is less than 1.0 cubic centimeters over a 24-hour period.

3. The liner of claim 1, wherein said oxygen transmission rate into said inner volume is less than 0.284 cubic centimeters over a 24-hour period.

4. The liner of claim 1, wherein said plurality of panels comprise a material that impedes transmission of UV rays.

5. The liner of claim 4, wherein an anti-UV component is added to said plurality of panels at about 0.1 wt % to 10 wt %.

6. The liner of claim 4, wherein an anti-UV component is added to said plurality of panels at about 1.5 wt % to 4 wt %.

7. The liner of claim 1, wherein said plurality of panels comprises a material selected from the group consisting essentially of nylon, ethylene vinyl alcohol, polyester, and any combinations thereof.

8. The liner of claim 1, wherein said plurality of panels comprise a plurality of layers secured to each other, and wherein at least one of said plurality of layers has a different material from another of said plurality of layers.

9. The liner of claim 1, wherein said plurality of panels comprise a plurality of layers secured to each other, and wherein at least one of said plurality of layers comprises ethylene vinyl acetate.

10. The liner of claim 1, wherein said plurality of panels comprise a plurality of layers secured to each other, and wherein at least one of said plurality of layers comprises low-density polyethylene.

11. An infant feeding assembly comprising:

a liner having a body defining a first volume; and a holder having an open end and defining a second volume, wherein said liner is disposed in said second volume, and wherein said body has a plurality of panels connected to each other to define said first volume and a closure member connected to said plurality of panels, said plurality of panels comprising an oxygen barrier, said closure member being selectively resealable, wherein said body and said closure member have an oxygen transmission rate into said first volume of less than about 2.0 cubic centimeters over a 24-hour period.

12. The assembly of claim 11, wherein said oxygen transmission rate into said first volume is less than about 1.0 cubic centimeters over a 24-hour period.

13. The assembly of claim 11, wherein said oxygen transmission rate into said first volume is less than about 0.284 cubic centimeters over a 24-hour period.

14. The assembly of claim 11, wherein said plurality of panels comprise a material that impedes transmission of UV rays.

15. The assembly of claim 14, wherein an anti-UV component is added to said plurality of panels at about 0.1 wt % to 10 wt %.

16. The assembly of claim 14, wherein an anti-UV component is added to said plurality of panels at about 1.5 wt % to 4 wt %.

17. The assembly of claim 11, wherein said plurality of panels are made of a material selected from the group consisting essentially of nylon, ethylene vinyl alcohol, polyester, and any combinations thereof.

18. A method of storing breast milk comprising:

providing a nurser liner with a plurality of panels having an oxygen barrier that limits an oxygen transmission rate into an inner volume of the nurser liner used for storing said breast milk to less than about 2.0 cubic centimeters over a 24-hour time period; and providing said nurser liner with a substantially air-tight resealable closure member connected to said plurality of panels.

19. The method of claim 18, further comprising limiting said oxygen transmission rate into said inner volume to less than about 1.0 cubic centimeters over a 24-hour period.

20. The method of claim 18, further comprising limiting said oxygen transmission rate into said inner volume to less than about 0.284 cubic centimeters over a 24-hour period.

21. The method of claim 18, wherein the step of limiting said oxygen transmission rate comprises:

forming at least a portion of a body of said nurser liner of a material selected from the group consisting essentially of nylon, ethylene vinyl alcohol, polyester, and any combinations thereof.

22. The method of claim 18, further comprising adding an anti-UV component to said nurser liner to impede transmission of UV rays into said inner volume.

23. The method of claim 22, wherein said anti-UV component is about 0.1 wt % to 10 wt % of said body of said nurser liner.

24. The method of claim 22, wherein said anti-UV component is about 1.5 wt % to 4 wt % of said body of said nurser liner.

* * * * *